US011564496B1

(12) United States Patent
Li et al.

(10) Patent No.: US 11,564,496 B1
(45) Date of Patent: Jan. 31, 2023

(54) INTERLOCKINGLY EXTENDING DRIVING MECHANISM FOR ELECTRIC SOFA

(71) Applicant: DewertOkin Technology Group Co., Ltd., Zhejiang (CN)

(72) Inventors: Long Li, Zhejiang (CN); Bin Shen, Zhejiang (CN); Pengfei He, Zhejiang (CN); Minglong Lei, Zhejiang (CN); Kangming Tao, Zhejiang (CN); Guangjiao Zhang, Zhejiang (CN)

(73) Assignee: DewertOkin Technology Group Co., Ltd., Jiaxing (CN)

( * ) Notice: Subject to any disclaimer, the term of this patent is extended or adjusted under 35 U.S.C. 154(b) by 0 days.

(21) Appl. No.: 17/462,312

(22) Filed: Aug. 31, 2021

(51) Int. Cl.
*A47C 1/03* (2006.01)
*A47C 1/034* (2006.01)
*A47C 17/04* (2006.01)

(52) U.S. Cl.
CPC ..... *A47C 1/034* (2013.01); *A47C 17/04* (2013.01)

(58) Field of Classification Search
CPC ..... A47C 1/034; A47C 1/031; A47C 1/0342; A47C 1/035; A47C 1/0345; A47C 17/04
USPC ..... 297/91
See application file for complete search history.

(56) References Cited

U.S. PATENT DOCUMENTS 8,979,186 B2 * 3/2015 Walz ..... A47C 1/0345 297/85 M
9,113,714 B2 * 8/2015 Natuzzi ..... A47C 1/0342
9,433,295 B2 * 9/2016 Crum ..... A47C 7/5068
9,700,140 B2 * 7/2017 Lawson ..... A47C 1/0345
9,844,269 B2 * 12/2017 Bryant ..... A47C 1/0242
9,845,852 B2 * 12/2017 Lawson ..... A47C 1/0355
11,266,245 B2 * 3/2022 Lawson ..... A47C 1/03211
2010/0127538 A1 * 5/2010 Hoffman ..... A47C 3/18 297/68
2010/0127555 A1 * 5/2010 Hoffman ..... A47C 3/0255 297/344.21
2010/0127556 A1 * 5/2010 Hoffman ..... A47C 1/0355 297/84
2015/0208805 A1 * 7/2015 Griggs, Jr. ..... A47C 7/00 74/89

FOREIGN PATENT DOCUMENTS

CN 202776984 U 3/2013
CN WO2015066943 * 5/2015

* cited by examiner

*Primary Examiner* — Mark R Wendell

(57) ABSTRACT

An interlockingly extending driving mechanism for an electric sofa, including a backrest adjusting assembly provided in a sofa seat frame. A footrest assembly is provided at one end, remote from the backrest, of the backrest adjusting assembly, and the backrest adjusting assembly is connected with the footrest adjusting assembly. The footrest adjusting assembly includes a supporting rod which is vertically and fixedly provided on the surface of one side of the backrest adjusting assembly, a driving unit is provided on the supporting rod, the driving unit is drivingly connected with a transmitting screw, an interlocking unit is movably connected to one end, close to the footrest, of the transmitting screw, the interlocking unit is movably connected with the footrest, and when the transmitting screw drives the interlocking unit to move, the interlocking unit drives the footrest assembly to extend or fold.

5 Claims, 4 Drawing Sheets

INTERLOCKINGLY EXTENDING DRIVING MECHANISM FOR ELECTRIC SOFA

STATEMENT REGARDING PRIOR DISCLOSURES BY AN INVENTOR OR JOINT INVENTOR

The contents of Chinese Patent Application No. 202020402284.8 filed on Mar. 25, 2020 and published on Nov. 27, 2020, is a grace period disclosure and shall not be prior art to claimed invention.

TECHNICAL FIELD

The present application relates to the field of electric sofas, and in particular to an interlockingly extending driving mechanism for an electric sofa.

BACKGROUND ART

People tend to feel fatigued after working for a long time. As commonly used furniture, a sofa can alleviate a user's fatigue with its good embracing feeling. At present, in order to improve user experience, the electric sofa gradually becomes popular. When the electric sofa is used, a footrest of the electric sofa can be lifted to support the lower leg, making the user more comfortable in resting.

For example, the utility model patent with the publication number CN202776984U discloses an electric massage chair with a muscle drawing function. The electric massage chair includes a chair seat and a movable backrest which is articulated on the chair seat; the chair seat is hinged to a movable seat plate which is hinged to a movable foot plate; an electric push rod I is articulated between the movable seat plate and the movable backrest; an electric push rod II is articulated between the movable seat plate and the movable foot plate; an electric air pump is arranged on the chair seat and is communicated with an air bag component; a control circuit is arranged on the chair seat; the electric push rod I, the electric push rod II, the electric air pump and the air bag component are electrically connected with the control circuit.

According to the technical solution, the movable rod is driven to act by the electric push rod II such that the movable foot plate can rotate around the hinge joint with the movable seat plate, and the movable foot plate tends to be in a horizontal state so as to support the lower leg. However, the electric push rod is large in size and has a lot of components such that the overall components and parts of the electric massage chair are too many, the structure is complex, and the overall cost of the electric massage chair is too high.

SUMMARY

In order to simplify the structure of the electric massage chair and reduce the cost, the present application provides an interlockingly extending driving mechanism for an electric sofa.

The interlockingly extending driving mechanism for an electric sofa provided by the present application adopts the following technical solution:

an interlockingly extending driving mechanism for an electric sofa, comprising a backrest adjusting assembly provided in a sofa seat frame, wherein a footrest assembly is provided at one end, remote from the backrest, of the backrest adjusting assembly, the backrest adjusting assembly is connected with a footrest adjusting assembly, the footrest adjusting assembly includes a supporting rod which is vertically and fixedly provided on a surface of one side of the backrest adjusting assembly, the supporting rod is provided with a driving unit, the driving unit is drivingly connected with a transmitting screw, an interlocking unit is movably connected to one end, close to the footrest assembly, of the transmitting screw, the interlocking unit is movably connected with the footrest assembly, and when the transmitting screw drives the interlocking unit to move, the interlocking unit drives the footrest assembly to extend or fold.

According to the technical solution, under the driving action of the driving unit, the transmitting screw drives the interlocking unit to operate to realize extending or folding of the footrest assembly such that the overall structure of the electric sofa is simplified, and the cost is reduced; meanwhile, because the driving unit is located at a relatively open position in the middle of the sofa, the driving unit, and the transmitting screw can be easily repaired.

In some embodiments, the driving unit includes a power module, the power module is drivingly connected with a transmitting module, and the transmitting module is movably provided on the supporting rod and drivingly connected with the transmitting screw.

In some embodiments, the transmitting module includes a housing in which a worm and a worm wheel are provided;

wherein one end of the worm is drivingly connected with the power module, and the other end of the worm meshes with the worm wheel;

a threaded hole matched with the transmitting screw is formed in a center of the worm wheel, and the transmitting screw penetrates through the housing and the worm wheel.

According to the technical solution, the worm and the worm wheel are matched to drive the transmitting screw to rotate such that the extending or folding process of the footrest assembly can be smoother, and noise is reduced.

In some embodiments, the interlocking unit includes a first connecting rod, a second connecting rod, a third connecting rod, and a fourth connecting rod, the first connecting rod and the third connecting rod being located on both sides of the second connecting rod;

one end of the second connecting rod is hinged to the backrest adjusting assembly, one end of the fourth connecting rod is hinged to the backrest adjusting assembly, and a hinge point of the fourth connecting rod and the backrest adjusting assembly is closer to the backrest relative to a hinge point of the second connecting rod and the backrest adjusting assembly;

the other end of the second connecting rod is hinged to one end of the first connecting rod; the other end of the fourth connecting rod is hinged to one end of the third connecting rod; the third connecting rod is hinged to the second connecting rod at the same time, and the hinge point of the third connecting rod and the second connecting rod is close to the hinge point of the third connecting rod and the fourth connecting rod;

the footrest assembly includes a connecting side plate, and the other end of the first connecting rod and the other end of the third connecting rod are hinged to the connecting side plate, and when the footrest assembly is in an extended state, the hinge point of the first connecting rod and the connecting side plate is closer to the backrest than the hinge point of the third connecting rod and the connecting side plate;

a driving rod is fixedly connected to the surface of one side of the second connecting rod close to the driving unit, and the middle part of the driving rod is movably connected with an end part of the transmitting screw, and when the transmitting screw rotates, the driving rod moves along an axial direction of the transmitting screw, and the driving rod drives the first connecting rod, the second connecting rod, the third connecting rod, and the fourth connecting rod to move to extend or fold the footrest assembly.

By adopting the technical solution, the interlocking unit can further drive the footrest assembly to extend or fold under the driving of the transmitting screw, and the interlocking unit is simple in structure and small in occupied space.

In some embodiments, a first limiting protrusion for limiting an angle of relative rotation between the first connecting rod and the third connecting rod is provided between the first connecting rod and the third connecting rod.

By adopting the technical solution, the relative rotation angle of the first connecting rod and the third connecting rod can be limited such that damage occasions caused by excessive rotation of the first connecting rod and the third connecting rod can be reduced.

In some embodiments, a second limiting protrusion for limiting the angle of relative rotation between the second connecting rod and the third connecting rod is provided between the second connecting rod and the third connecting rod.

By adopting the technical solution, the relative rotation angle of the second connecting rod and the third connecting rod can be limited such that damage occasions caused by excessive rotation of the second connecting rod and the third connecting rod can be reduced.

In summary, the present application has at least one of the following technical effects.

1. The driving unit is adopted to drive the interlocking unit to move through the transmitting screw to further extend or fold the footrest assembly, the overall structure of the electric sofa is simplified, and the cost is reduced;

2. the worm wheel and the worm are matched to drive the transmitting screw to rotate such that the extending or folding process of the footrest assembly is smoother, and the noise of the electric sofa during the adjustment is reduced;

3. by providing the first limiting protrusion and the second limiting protrusion, the movement stroke of the interlocking unit can be limited, and the damage occasions are reduced;

4. the driving unit is located at an open position in the sofa, the shielding structures are few, and the sofa is easy to disassemble and repair;

5. the backrest adjusting assembly and the driving unit of the footrest adjusting assembly occupy little space in the width direction of the sofa, and are easy to apply to a small sofa.

DESCRIPTION OF THE EMBODIMENTS

The present application is described in further detail below with reference to FIGS. 1-4.

Figure 1:
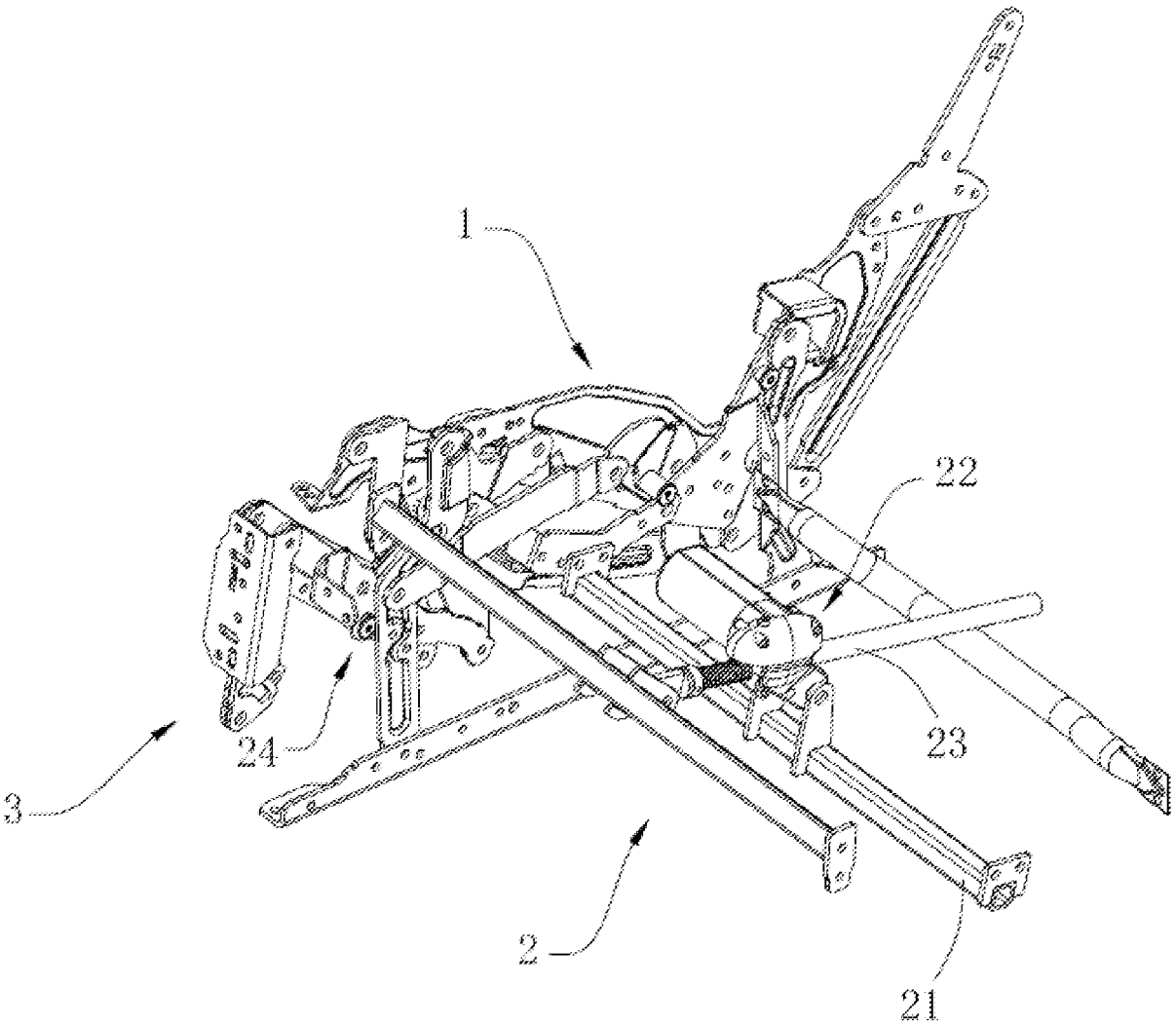
FIG. 1 is a schematic diagram showing a three-dimensional structure of an interlockingly extending driving mechanism for an electric sofa according to the present application.

Referring to FIG. 1, an embodiment of the present application discloses an interlockingly extending driving mechanism for an electric sofa, including a backrest adjusting assembly 1 which is used for adjusting the angle of a backrest. In the present application, the backrest adjusting assembly 1 is formed by connecting several plate-shaped components, and a footrest assembly 3 is provided at one end of the backrest adjusting assembly 1 remote from the backrest. The backrest adjusting assembly 1 is connected with a footrest adjusting assembly 2, which is used for driving the footrest assembly 3 to extend or fold.

The footrest adjusting assembly 2 includes a supporting rod 21 fixedly connected with one side surface of the backrest adjusting assembly 1, the supporting rod 21 is perpendicular to the backrest adjusting assembly 1, and the end part of the supporting rod 21 can be fixed with the backrest adjusting assembly 1 through a bolt. The supporting rod 21 is provided with a driving unit 22, and the driving unit 22 is drivingly connected with a transmitting screw 23 with an axis parallel to the backrest adjusting assembly 1. One end of the transmitting screw 23 remote from the backrest is movably connected with an interlocking unit 24, and one end of the interlocking unit 24 remote from the backrest is connected with the footrest assembly 3. When the driving unit 22 drives the transmitting screw 23 to transmit, the transmitting screw 23 can move along the axis direction thereof, and the transmitting screw 23 further drives the interlocking unit 24 to operate such that the foot-supporting assembly 3 can be extended or folded.

Figure 2:
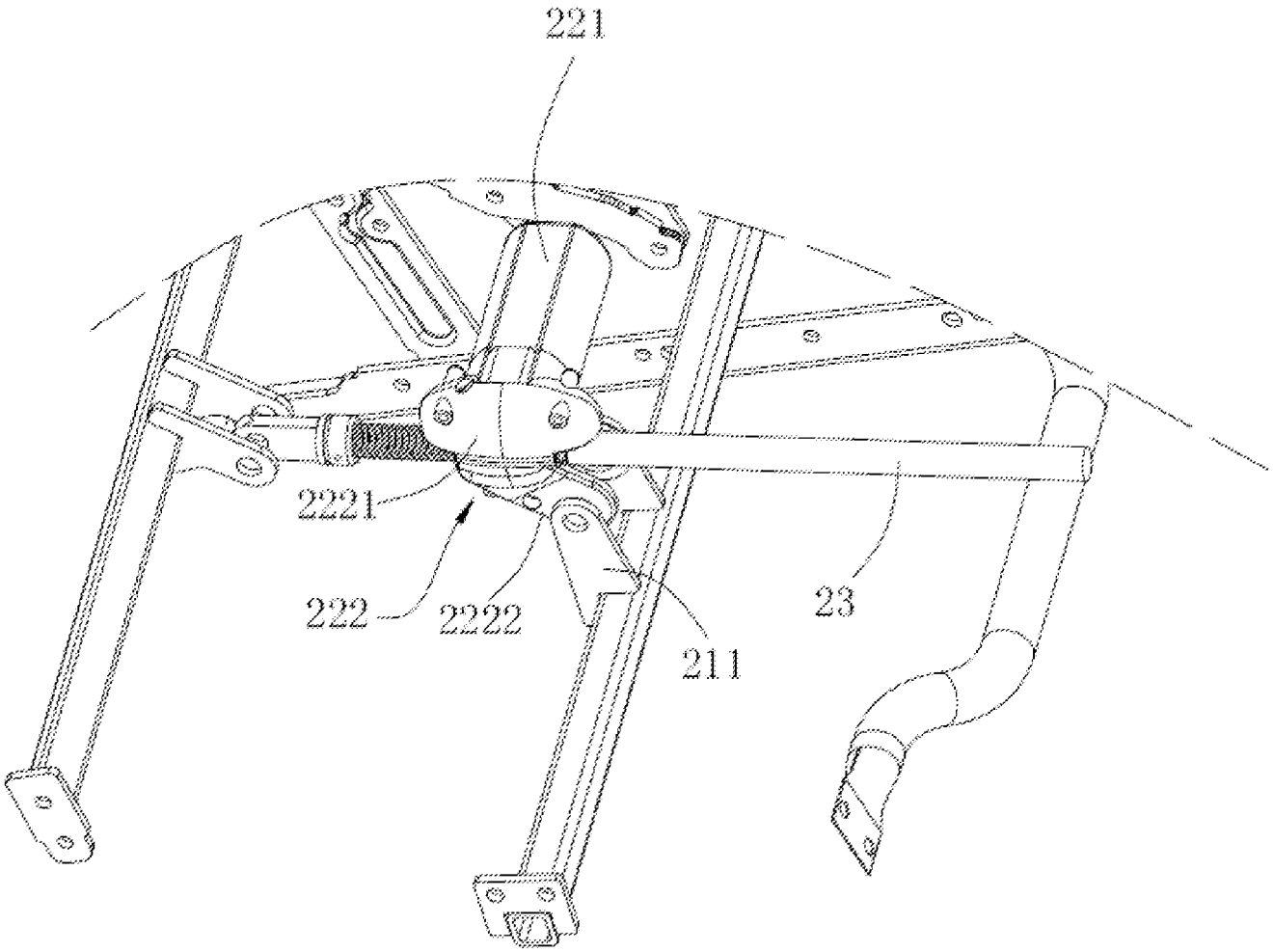
FIG. 2 is a schematic diagram showing a three-dimensional structure of a driving unit and a transmitting screw part according to the present application.

Specifically, referring to FIGS. 1 and 2, the driving unit 22 includes a power module 221, which may adopt a driving motor existing in the art, and a transmitting module 222. The transmitting module 222 includes a housing 2221, two connecting plates 2222 are fixedly provided on one side surface, close to the ground, of the housing 2221, and two supporting plates 211 corresponding to the connecting plate 2222 are correspondingly provided on the supporting rod 21. The connecting plate 2222 is hinged to the end part of the supporting plate 211 such that the transmitting module 222 itself has the necessary movable space when it drives the interlocking unit 24 to move through the transmitting screw 23. The axis of rotation of the housing 2221 is perpendicular to the backrest adjusting assembly 1.

A worm and a worm wheel that are meshed are provided in the housing 2221, and one end of the worm is drivingly connected with an output shaft of the driving module. A threaded hole matched with the transmitting screw 23 is formed in the center of the worm wheel, and the transmitting screw 23 penetrates through the housing 2221 and the worm wheel. When the worm drives the worm wheel to rotate, the worm wheel can drive the transmitting screw 23 to move along its own axis.

In the present application, the housing 2221 may include a first housing part of an integral structure that is located close to the power module 221. Two second housing parts may be provided at one side of the first housing part remote from the power module 221, and the first housing part may be connected to the two second housing parts by a bolt to be assembled as a whole. By setting the housing 2221 as a split structure, it is convenient to disassemble and repair or replace when a component inside the housing 2221 is damaged.

Figure 3:
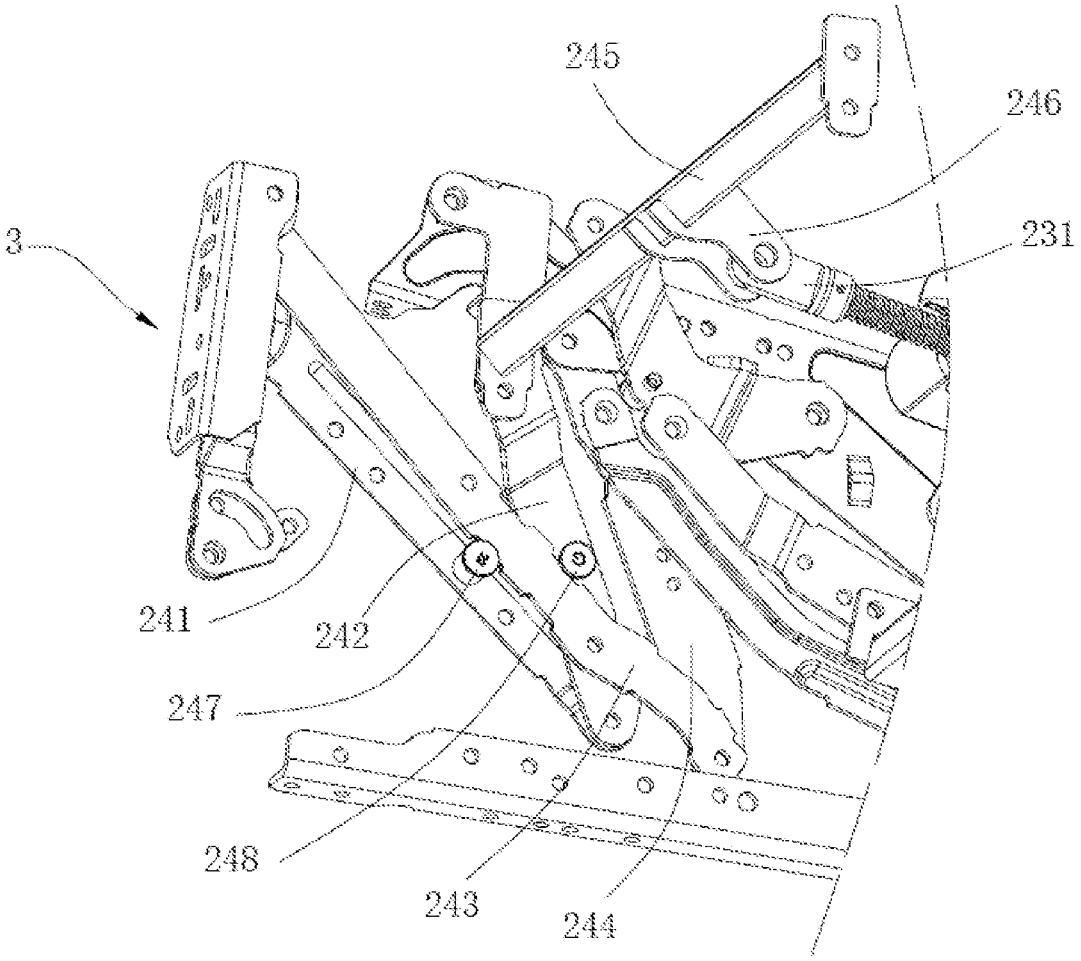
FIG. 3 is a schematic diagram showing a three-dimensional structure of an interlocking unit according to the present application.
Figure 4:
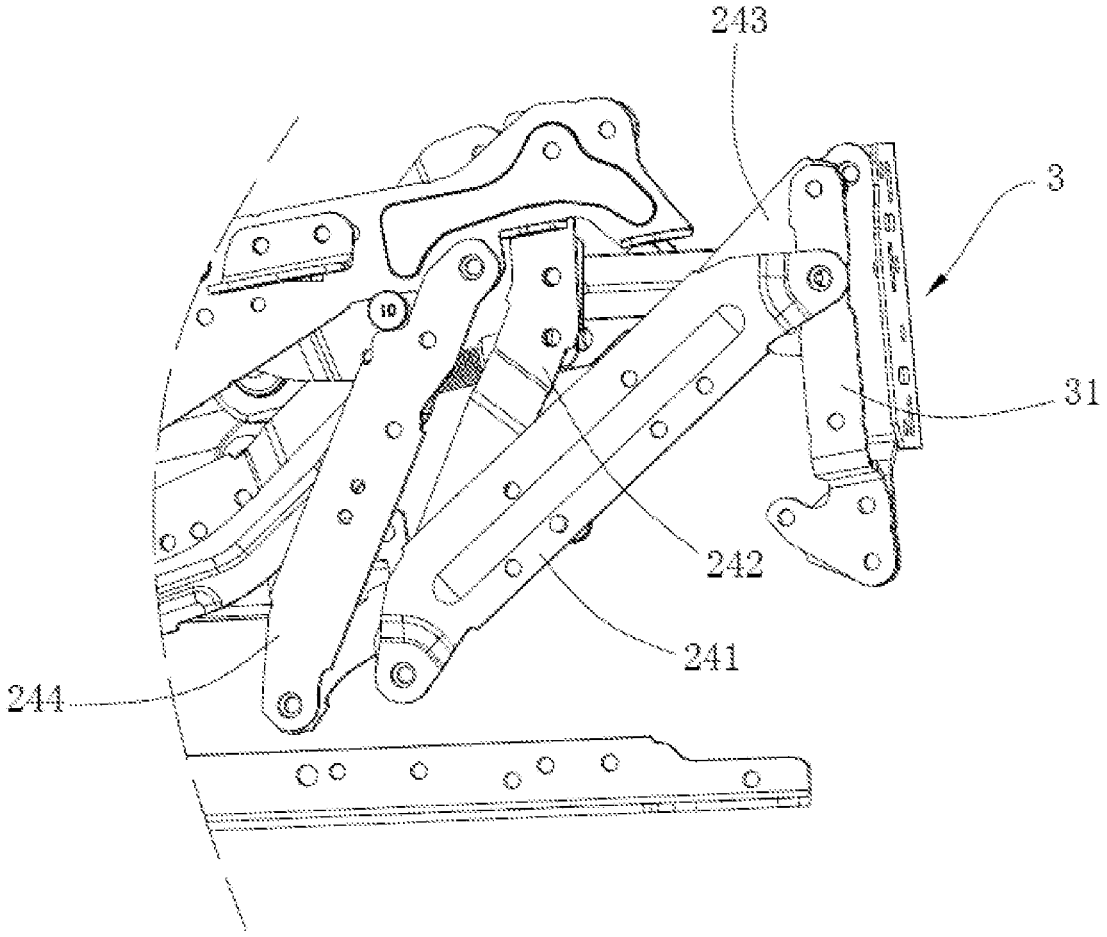
FIG. 4 is a schematic diagram showing a three-dimensional structure of the interlocking unit from another perspective according to the present application.

Referring to FIGS. 3 and 4, the interlocking unit 24 includes a first connecting rod 241, a second connecting rod 242, a third connecting rod 243, and a fourth connecting rod 244, each of the four having a plate-shaped structure and the first connecting rod 241 and the third connecting rod 243 being located at both sides of the second connecting rod 242.

One end of the second connecting rod 242 and one end of the fourth connecting rod 244 are both hinged to the upper part of one end of the backrest adjusting assembly 1 remote from the backrest, and the hinge point of the fourth connecting rod 244 and the backrest adjusting assembly 1 is closer to the backrest than the hinge point of the second connecting rod 242 and the backrest adjusting assembly 1.

The other end of the second connecting rod 242 is hinged to one end of the first connecting rod 241, and the other end of the fourth connecting rod 244 is hinged to one end of the third connecting rod 243. Besides, the second connecting rod 242 is simultaneously hinged to the third connecting rod 243, and the hinge point of the second connecting rod 242 and the third connecting rod 243 is close to the hinge point of the third connecting rod 243 and the fourth connecting rod 244.

Referring to FIG. 4, the footrest assembly 3 includes a connecting side plate 31 provided near one side of the backrest. The other end of the first connecting rod 241 and the other end of the third connecting rod 243 are both hinged to the connecting side plate 31. The hinge point of the third connecting rod 243 and the connecting side plate 31 is closer to one side of the backrest than the hinge point of the first connecting rod 241 and the connecting side plate 31 when the footrest assembly 3 is in an extended state to support the lower leg.

Referring to FIG. 3, a driving rod 245 is fixedly connected to the surface of one side of the second connecting rod 242 close to the driving unit 22, and a first connecting seat 246 extending to one side of the driving unit 22 is fixedly connected to the middle of the driving rod 245. Accordingly, a second connecting seat 231 is provided at the end part of the transmitting screw 23 close to the driving rod 245, and the first connecting seat 246 is hinged to the second connecting seat 231.

One end of the second connecting seat 231 close to the driving unit 22 is sleeve-shaped, and the inner diameter of the end part thereof is smaller than the inner diameter of the part of the cylindrical structure remote from the driving unit 22. A limiting sheet matched with the cylindrical structure is fixedly provided at one end, close to the second connecting seat 231, of the transmitting screw 23, the limiting sheet is located in the cylindrical structure, and the diameter of the limiting sheet is larger than that of the end part of the cylindrical structure such that the transmitting screw 23 can rotate relative to the second connecting seat 231 and pull the second connecting seat 231.

When the transmitting screw 23 rotates, the driving rod 245 can be pulled or pushed to move through the second connecting seat 231 and the first connecting seat 246, and the driving rod 245 further drives the four connecting rods to move to extend or fold the footrest assembly 3.

Referring to FIG. 3, in order to prevent the four links of the driving unit 22 from excessively moving beyond the allowable stroke range when the footrest assembly 3 is folded, a first limiting protrusion 247 is further provided between the first connecting rod 241 and the third connecting rod 243, and a second limiting protrusion 248 is further provided between the second connecting rod 242 and the third connecting rod 243. The first limiting protrusion 247 can be provided on the surface of the first connecting rod 241 close to the third connecting rod 243 or on the surface of the third connecting rod 243 close to the first connecting rod 241; the second limiting protrusion 248 can be provided on the surface of the second connecting rod 242 close to the third connecting rod 243 or the surface of the third connecting rod 243 close to the second connecting rod 242. The first limiting protrusion 247 and the second limiting protrusion 248 are preferably made of an elastic material and may be fixed to the corresponding connecting rod by a bolt to reduce damage to the corresponding connecting rod. In addition, a person skilled in the art can set the size and position of the first limiting protrusion 247 and the second limiting protrusion 248 as required.

The working principle of the interlockingly extending driving mechanism for an electric sofa provided by the invention is as follows:

when the footrest assembly 3 needs to be unfolded, a user can control the driving motor to rotate in one direction through the control element provided on the sofa, and at the moment, the driving motor drives the transmitting screw 23 to rotate through a worm and a worm wheel, and the transmitting screw 23 simultaneously moves axially away from the interlocking unit 24 in the rotating process. The transmitting screw 23 further pulls the driving rod 245 to move and acts through the first connecting rod 241, the second connecting rod 242, the third connecting rod 243, and the fourth connecting rod 244 to facilitate the movement of the footrest assembly 3 in the extending direction, thereby enabling the supporting of the lower leg of a user.

When the footrest assembly 3 needs to be folded, the driving motor runs in the opposite direction.

According to the interlockingly extending driving mechanism for an electric sofa provided by the present application, the structure is simple, the cost is low, and as the driving unit 22 is located at a relatively open position in the sofa, the peripheral shielding structures are few, and the disassembly and the repairment are easy; in addition, the driving unit 22 of the backrest adjusting assembly 1 and the footrest adjusting assembly 2 occupies little space in the width direction of the sofa and is easy to apply to a small sofa.

When the interlockingly extending driving mechanism provided by the present application is applied to an electric sofa, except for the middle driving unit 22, the transmitting screw 23 and the driving rod 245, the backrest adjusting assembly 1, four connecting rods of the interlocking unit 24, the footrest assembly 3, and the like can be symmetrically provided at two ends of the supporting rod 21 such that a complete electric seat can be supported and adjusted.

The above are preferred embodiments of the present application, and do not limit the scope of the present application accordingly. Therefore: all equivalent changes made in accordance with the structure, shape, and principle of the present application shall be covered by the scope of the present application.

What is claimed is:

1. An interlockingly extending driving mechanism for an electric sofa, comprising a backrest adjusting assembly provided in a sofa seat frame, wherein a footrest assembly is provided at one end, remote from the backrest, of the backrest adjusting assembly, and the backrest adjusting assembly is connected with a footrest adjusting assembly, wherein the footrest adjusting assembly comprises a supporting rod which is vertically and fixedly provided on a surface of one side of the backrest adjusting assembly, the supporting rod is provided with a driving unit, the driving unit is drivingly connected with a transmitting screw, an interlocking unit is movably connected to one end, close to the footrest assembly, of the transmitting screw, the interlocking unit is movably connected with the footrest assembly, and when the transmitting screw drives the interlocking unit to move, the interlocking unit drives the footrest assembly to extend or fold;

wherein the interlocking unit comprises a first connecting rod, a second connecting rod, a third connecting rod, and a fourth connecting rod, the first connecting rod and the third connecting rod being located on both sides of the second connecting rod;

one end of the second connecting rod is hinged to the backrest adjusting assembly, one end of the fourth connecting rod is hinged to the backrest adjusting assembly, and a hinge point of the fourth connecting rod and the backrest adjusting assembly is closer to the backrest relative to a hinge point of the second connecting rod and the backrest adjusting assembly;

the other end of the second connecting rod is hinged to one end of the first connecting rod; the other end of the fourth connecting rod is hinged to one end of the third connecting rod; the third connecting rod is hinged to the second connecting rod at the same time, and the hinge point of the third connecting rod and the second connecting rod is close to the hinge point of the third connecting rod and the fourth connecting rod;

the footrest assembly comprises a connecting side plate, and the other end of the first connecting rod and the other end of the third connecting rod are hinged to the connecting side plate, and when the footrest assembly is in an extended state, the hinge point of the first connecting rod and the connecting side plate is closer to the backrest than the hinge point of the third connecting rod and the connecting side plate;

a driving rod is fixedly connected to a surface of one side of the second connecting rod close to the driving unit, and a middle part of the driving rod is movably connected with an end part of the transmitting screw, and when the transmitting screw rotates, the driving rod moves along an axial direction of the transmitting screw, and the movable rod drives the first connecting rod, the second connecting rod, the third connecting rod, and the fourth connecting rod to move so as to extend or fold the footrest assembly.

2. The interlockingly extending driving mechanism according to claim 1, wherein the driving unit comprises a power module, the power module is drivingly connected with a transmitting module, and the transmitting module is movably provided on the supporting rod and drivingly connected with the transmitting screw.

3. The interlockingly extending driving mechanism according to claim 2, wherein the transmitting module comprises a housing in which a worm and a worm wheel are provided;

wherein one end of the worm is drivingly connected with the power module, and the other end of the worm meshes with the worm wheel;

a threaded hole matched with the transmitting screw is formed in a center of the worm wheel, and the transmitting screw penetrates through the housing and the worm wheel.

4. The interlockingly extending driving mechanism according to claim 1, wherein a first limiting protrusion for limiting an angle of relative rotation between the first connecting rod and the third connecting rod is provided between the first connecting rod and the third connecting rod.

5. The interlockingly extending driving mechanism according to claim 1, wherein a second limiting protrusion for limiting the angle of relative rotation between the second connecting rod and the third connecting rod is provided between the second connecting rod and the third connecting rod.

* * * * *